US007819199B2

(12) United States Patent
Freyer

(10) Patent No.: US 7,819,199 B2
(45) Date of Patent: Oct. 26, 2010

(54) METHOD AND A DEVICE FOR SETTING A CASING

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 75 days.

(21) Appl. No.: 11/577,698

(22) PCT Filed: Oct. 21, 2005

(86) PCT No.: PCT/NO2005/000398

§ 371 (c)(1),
(2), (4) Date: Nov. 3, 2008

(87) PCT Pub. No.: WO2006/043829

PCT Pub. Date: Apr. 27, 2006

(65) Prior Publication Data

US 2009/0065219 A1 Mar. 12, 2009

(30) Foreign Application Priority Data

Oct. 22, 2004 (NO) ..... 20044536

(51) Int. Cl.
*E21B 33/12* (2006.01)
*E21B 33/13* (2006.01)

(52) U.S. Cl. ..... 166/387; 166/179; 166/121; 166/120

(58) Field of Classification Search ..... 166/101, 166/114, 116, 115, 196, 380, 387, 120, 121
See application file for complete search history.

(56) References Cited

U.S. PATENT DOCUMENTS 1,697,249 A * 1/1929 Macready ..... 166/264
1,921,472 A * 8/1933 Macready ..... 166/148
2,033,564 A * 3/1936 Wells et al. ..... 166/183
2,091,428 A * 8/1937 Burt ..... 166/193
2,196,668 A * 4/1940 Ragan ..... 166/122

(Continued)

FOREIGN PATENT DOCUMENTS

EP 1277915 1/2003

(Continued)

OTHER PUBLICATIONS

Norwegian Search Report for application No. 20044536.

(Continued)

*Primary Examiner*—William P Neuder
*Assistant Examiner*—Michael Wills, III
(74) *Attorney, Agent, or Firm*—Marlin R. Smith

(57) ABSTRACT

A method for setting a casing in a reduced diameter portion of a well bore whereby at least one annular packer may be positioned on an external surface of the casing and the packer may be conveyed into the reduced diameter portion of the well bore, thereby setting the casing. Cement can then be used to fill a region of an annulus formed between the external surface of the casing and the well bore above the packer. The packer may be preloaded, swellable, or expandable. The packer can be conveyed by applying a differential pressure to the packer, which longitudinally displaces the packer relative to the casing and forces the packer into the reduced diameter portion of the well bore.

26 Claims, 3 Drawing Sheets

U.S. PATENT DOCUMENTS

| | | | | |
|---|---|---|---|---|
| 2,370,929 | A * | 3/1945 | Barnes | 277/338 |
| 2,575,238 | A * | 11/1951 | Stenger | 423/193 |
| 2,813,589 | A * | 11/1957 | Woodruff | 166/319 |
| 3,052,302 | A | 9/1962 | Lagucki | |
| 3,062,291 | A * | 11/1962 | Brown | 166/119 |
| 3,575,238 | A * | 4/1971 | Shillander | 166/187 |
| 4,137,970 | A | 2/1979 | Laflin et al. | |
| 5,024,273 | A * | 6/1991 | Coone et al. | 166/289 |
| 5,195,583 | A * | 3/1993 | Toon et al. | 166/187 |
| 2004/0020662 | A1* | 2/2004 | Freyer | 166/387 |
| 2004/0055760 | A1* | 3/2004 | Nguyen | 166/387 |
| 2004/0231861 | A1* | 11/2004 | Whanger et al. | 166/387 |
| 2005/0230108 | A1* | 10/2005 | Mackenzie et al. | 166/250.01 |

FOREIGN PATENT DOCUMENTS

| | | |
|---|---|---|
| GB | 2370301 | 6/2002 |
| GB | 2398313 | 8/2004 |

OTHER PUBLICATIONS

International Preliminary Report on Patentability for application No. PCT/NO2005/000398.

International Search Report for application No. PCT/NO2005/000398.

Written Opinion of the International Searching Authority for PCT/NO2005/000398.

* cited by examiner

METHOD AND A DEVICE FOR SETTING A CASING

CROSS-REFERENCE TO RELATED APPLICATIONS

The present application is a national stage application under 35 USC 371 of International Application No. PCT/NO2005/000398, filed on Oct. 21, 2005, which claims priority to Norwegian Application No. 20044536, filed on Oct. 22, 2004. The entire disclosures of these prior applications are incorporated herein by this reference.

This invention relates to a method for setting a casing. More particularly, it concerns a method for setting a casing against a formation, in which the casing is set against the formation wall by means of a packer, the packer being run into an annulus between the casing and the formation wall. The invention also includes a device for practicing the method.

BACKGROUND

In the drilling of, for example, a petroleum well in the ground it is common, according to the prior art, to cement the casing to the formation. The aim is to connect the casing to the formation and prevent the flow of well fluid and drilling fluid through an annulus between the casing and the formation wall.

Cementation of this kind is relatively time-consuming, and it is known that such cementation may cause problems with, for example, formation stability and fracturing pressure.

The invention has as its object to remedy or reduce at least one of the drawbacks of the prior art.

The object is realized in accordance with the invention through the features specified in the description below and in the following Claims.

SUMMARY

The setting of a casing against a formation, wherein the casing is run into a bore in the formation, may with advantage be carried out by placing the packer in a preloaded manner in an annulus between the casing and the bore. It is advantageous that the packer is tight.

The packer may be connected to the casing and run into the bore together with the casing. Alternatively, at least part of the packer may be movable along the casing and be moved into said annulus by means of, for example, differential pressure.

The packer should be elastic in order to achieve satisfactory sealing against the formation. An expandable or swellable packer may be used with advantage.

Packers for this purpose may be composed of different materials, which may be telescopic between themselves, and the external diameter may change continuously or in steps in the longitudinal direction of the plug.

If desirable, the area above the plug may be cemented, for example by passing cement 20 through perforations 18 in the casing, as depicted in FIG. 3. These perforations may be provided with check valves.

In a further embodiment the packer may be placed at the bottom of the borehole. It is not necessary to provide the borehole with a larger diameter at the packer. The packer is compressed by means of weight from the casing.

It is known that, due to the risk of a cave-in, well equipment should not be run into an uncased well if there is little clearance, for example less than 10 mm, between the equipment and the well wall. The reason may be that relatively great flow rates easily occur in this space when the equipment is moved within the well. The method and the device according to the invention are suitable also for openings of less than 10 mm and may also be used with openings of less than 5 mm.

In what follows is described a non-limiting example of a preferred method and embodiment visualized in the accompanying drawings, in which:

DETAILED DESCRIPTION

Figure 1:
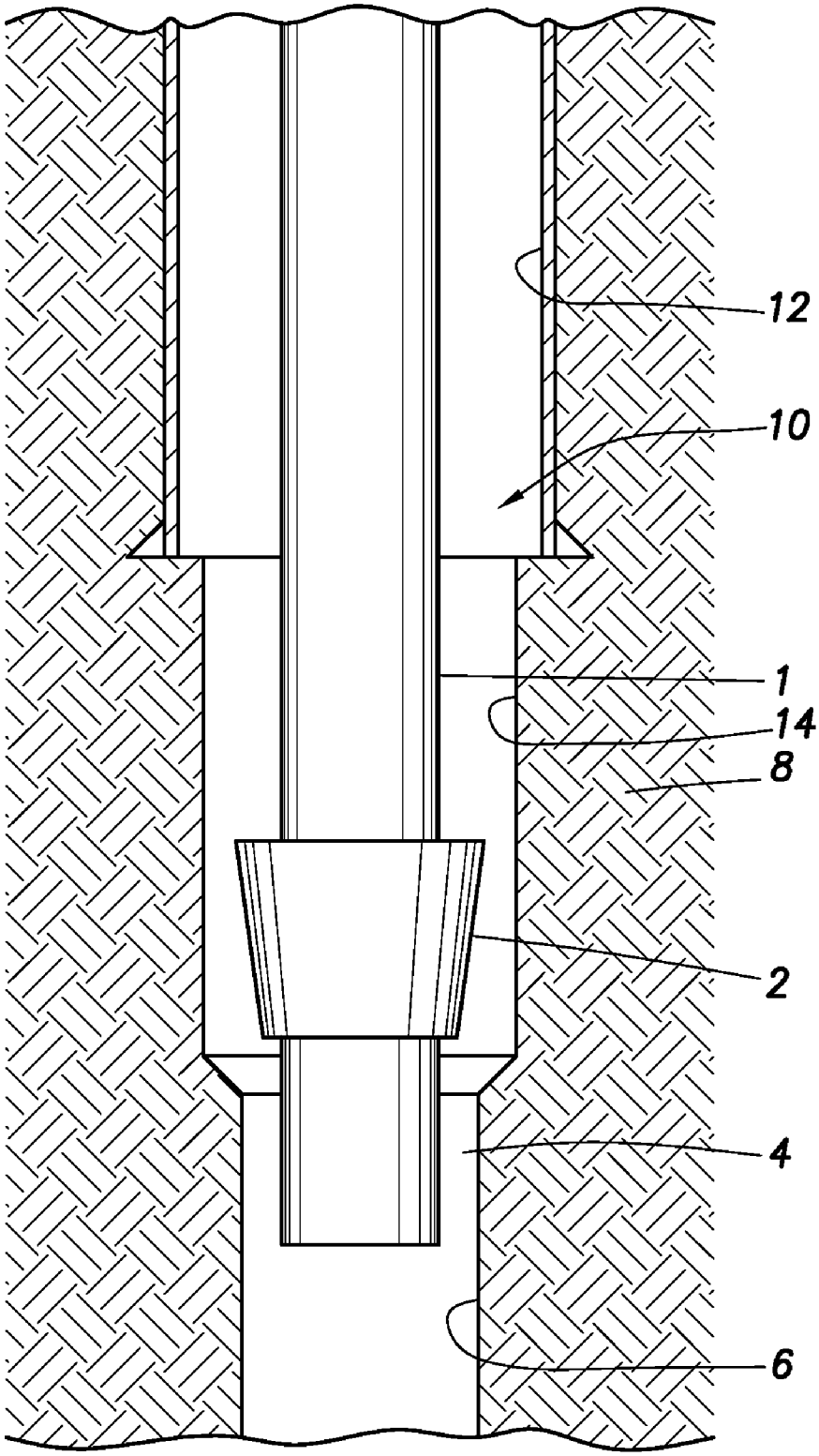
FIG. 1 shows schematically a casing which is being run into a bore in a well formation.

In the drawings the reference numeral 1 identifies a casing which is provided with a first packer 2. In FIG. 1 the casing 1 is being run into an annulus 4 located between the casing 1 and a bore 6 in a well formation 8.

The bore 6, which forms part of a well 10, has a diameter approximately equal to or smaller than that of a possible above casing 12. In the drawings is shown a transitional portion 14 between the casing 12 and the bore 6. This transitional portion 14 may have a diameter which is larger than the diameter of the casing 12.

Figure 2:
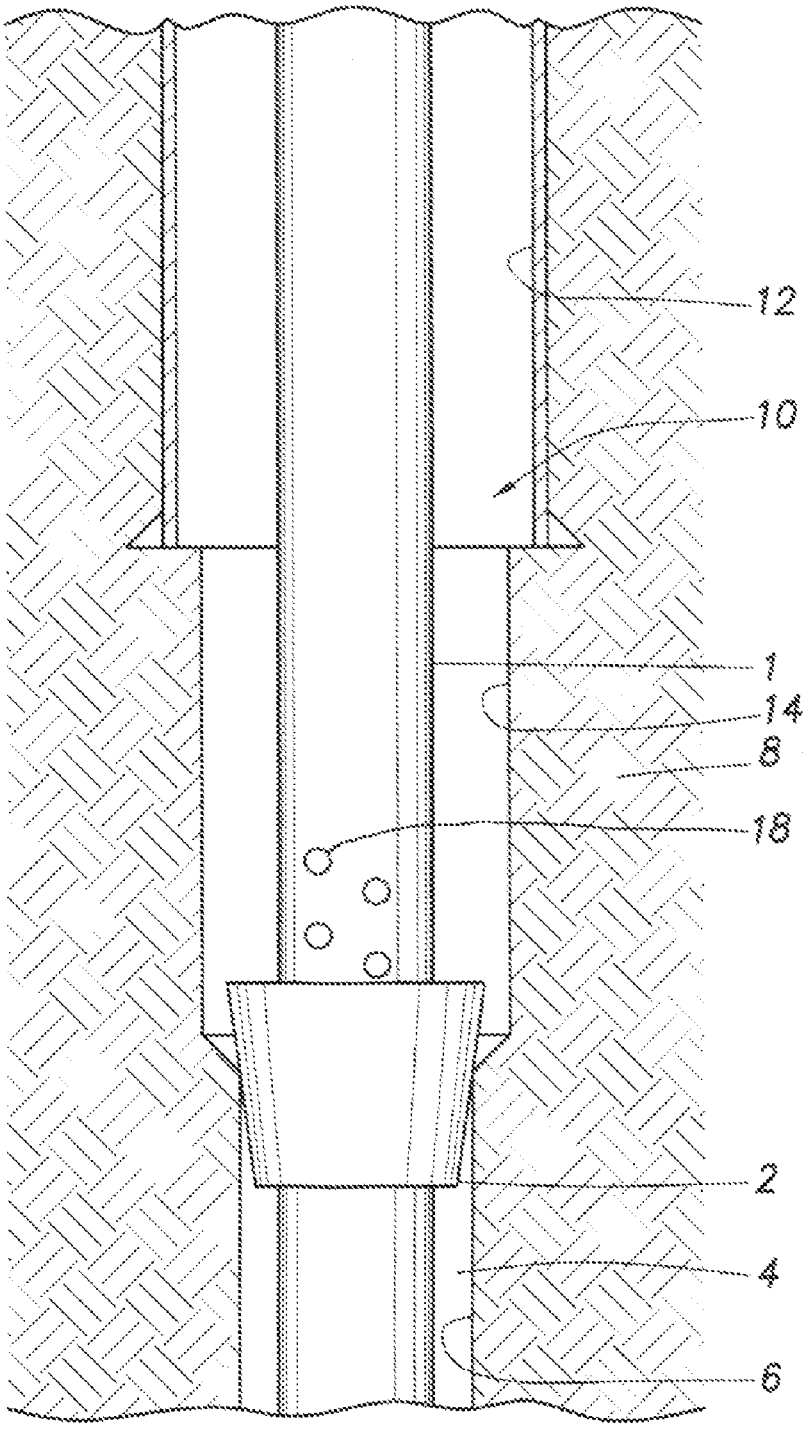
FIG. 2 shows schematically the casing after it has been placed in the bore, a packer connecting the casing with the well formation.

The first packer 2 is run, preloaded, into the annulus 4, see FIG. 2, after which, if desirable, the casing may be moved further into the bore 6.

In this preloaded position the first packer 2 connects the casing 1 with the well formation 8, and isolates at the same time the annulus 4 from the rest of the well 10.

In the figures, the first packer 2 is shown as a conical packer which is run into the annulus by means of the thrust of the casing 1. The first packer 2 may be formed as an expanding or swelling packer, so that it will tighten further after it has been placed in the annulus 4.

Figure 3:
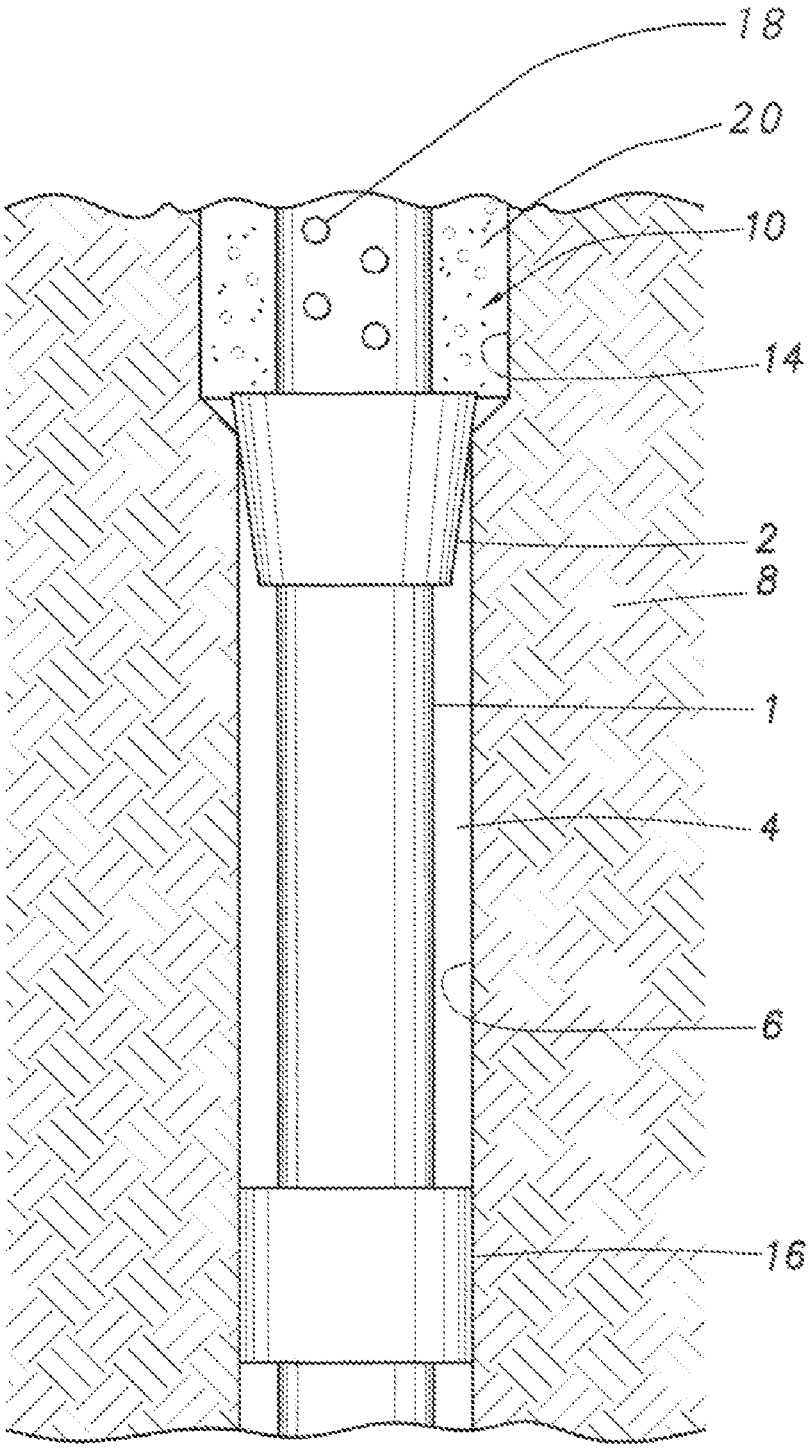
FIG. 3 shows schematically the casing in an embodiment, in which two packers are used.

In a further embodiment, see FIG. 3, a second packer 16 is placed in the annulus at a level of height somewhat lower than the first packer 2.

The purpose of the second packer 16 is to connect further the casing 1 to the well formation 8, or to isolate a portion of the annulus 4 from the rest of the well 10.

FIG. 3 depicts the packer 16 after it has been run into the annulus 4 and expanded, or swollen, to contact the bore 6 along the length of the packer 16.

The invention claimed is:

1. A method for setting a casing in a reduced diameter portion of a well bore in a formation, the method comprising the steps of:

positioning at least one annular packer on an external surface of the casing;

conveying the packer into the reduced diameter portion of the well bore, at least a portion of the packer being larger in diameter than the reduced diameter portion of the well bore; and filling with cement a region of an annulus formed between the external surface of the casing and the well bore above the packer.

2. The method of claim 1, wherein the packer is preloaded due to a tight fit with the reduced diameter portion of the well bore.

3. The method of claim 1, further comprising the step of expanding the packer when the packer is in the reduced diameter portion of the well bore.

4. The method of claim 1, further comprising the step of swelling the packer when the packer is in the reduced diameter portion of the well bore.

5. The method of claim 1, wherein the conveying step comprises forcing the packer into the reduced diameter portion of the well bore by means of differential pressure.

6. The method of claim 1, wherein the packer is elastic.

7. The method of claim 1, wherein the packer is expandable.

8. The method of claim 1, wherein the packer is swellable.

9. The method of claim 1, further comprising the step of setting the packer and thereby sealing the casing within an annular radial clearance of less than 10 mm.

10. The method of claim 1, further comprising the step of flowing the cement into the annulus via perforations in the casing.

11. The method of claim 1, further comprising the step of setting the packer and thereby sealing the casing within a radial clearance in the annulus of less than 5 mm.

12. The method of claim 1, wherein the packer is movable along the casing.

13. The method of claim 1, wherein the packer is connected to the external surface of the casing.

14. A method for setting a casing in a reduced diameter portion of a well bore in a formation, the method comprising the steps of:

positioning at least one annular packer on an external surface of the casing;

conveying the packer into the reduced diameter portion of the well bore, at least a portion of the packer being larger in diameter than the reduced diameter portion of the well bore; and wherein the conveying step includes applying a differential pressure to the packer, thereby longitudinally displacing the packer relative to the casing and forcing the packer into the reduced diameter portion of the well bore.

15. The method of claim 14, wherein the packer is preloaded due to a tight fit with the reduced diameter portion of the well bore.

16. The method of claim 14, further comprising the step of expanding the packer when the packer is in the reduced diameter portion of the well bore.

17. The method of claim 14, further comprising the step of swelling the packer when the packer is in the reduced diameter portion of the well bore.

18. The method of claim 14, wherein the packer is elastic.

19. The method of claim 14, wherein the packer is expandable.

20. The method of claim 14, wherein the packer is swellable.

21. The method of claim 14, further comprising the step of setting the packer and thereby sealing the casing within an annular radial clearance of less than 10 mm.

22. The method of claim 14, further comprising the step of filling with cement a region of an annulus formed between an external surface of the casing and the well bore above the packer.

23. The method of claim 22, further comprising the step of flowing the cement into the annulus via perforations in the casing.

24. The method of claim 22, further comprising the step of setting the packer and thereby sealing the casing within a radial clearance in the annulus of less than 5 mm.

25. The method of claim 14, wherein the packer is movable along the casing.

26. The method of claim 14, wherein the packer is connected to the external surface of the casing.

* * * * *